US005631881A

United States Patent [19]

Pessey et al.

[11] Patent Number: 5,631,881

[45] Date of Patent: May 20, 1997

[54] PUSH BUTTON ASSEMBLY FOR AN ELECTRONIC WRIST INSTRUMENT

[75] Inventors: Claude Pessey, Pirey; Paul G. Chavin, Besancon, both of France

[73] Assignee: Timex Corporation, Middlebury, Conn.

[21] Appl. No.: 641,670

[22] Filed: May 1, 1996

[51] Int. Cl.[6] ..... G04B 29/00

[52] U.S. Cl. ..... 368/290; 368/319

[58] Field of Search ..... 368/286–292, 368/306–307, 319–321; 200/264, 302

[56] References Cited

U.S. PATENT DOCUMENTS

| | | | |
|---|---|---|---|
| 3,621,649 | 11/1971 | Vulcan et al. | 368/290 |
| 3,783,607 | 1/1974 | Feurer | 368/290 |
| 4,031,348 | 6/1977 | Eberhardt | 200/159 |
| 4,400,095 | 8/1983 | Namyslo | 368/321 |
| 4,408,901 | 10/1983 | Gagnesin | 368/321 |
| 4,468,134 | 8/1984 | Halicho | 368/309 |

FOREIGN PATENT DOCUMENTS

| | | | |
|---|---|---|---|
| 201681 | 3/1939 | Switzerland | 368/290 |
| 375291 | 10/1963 | Switzerland | 368/289 |
| 604357 | 9/1978 | Switzerland | 368/321 |

*Primary Examiner*—Vit W. Miska

*Attorney, Agent, or Firm*—William C. Crutcher

[57] ABSTRACT

A push button assembly for an electronic wrist instrument requires only two components, a push button member and a gasket which dually functions as a spring, thereby reducing the cost of manufacturing and easing assembly.

13 Claims, 2 Drawing Sheets

PUSH BUTTON ASSEMBLY FOR AN ELECTRONIC WRIST INSTRUMENT

This invention relates generally to an improved push button assembly for an electronic wrist instrument. More specifically, the invention relates to an improved push button assembly for an electronic wrist instrument which simply requires two components, a push button member and a gasket which dually functions as a spring, thereby reducing the cost of manufacturing and easing assembly.

BACKGROUND OF THE INVENTION

In the use of an electronic wrist instrument, it is usually necessary to have at least one push button which enables a user to select and engage desired functions of the wrist instrument. For example, where the electronic wrist instrument is a digital watch, the push button may be utilized by a user to illuminate the watch display by activating a light source, to select desired display functions, or to set information being displayed.

Typically, as shown in FIG. 1, the prior art push button assembly 10 for an electronic wrist instrument includes a push button member 12 having a stem 12*a*, where the push button member 12 is received by a bore 14 located in a portion of the wrist instrument's case 20. A retainer clip 16, such as an O-ring, is disposed about the stem 12*a* to retain the push button member 12 within the bore 14 and a spring 18 is disposed about the stem 12*a* to provide tension on the push button member 12. Furthermore, a dynamic seal 19 is disposed about the stem 12*a* to minimize or prevent moisture or other contaminants from entering the interior of the wrist instrument's case 20 where delicate electronic components can be adversely affected. As is well-known in the art, the push button assembly 10 functions by selectively operating a switch 24 connected to an integrated circuit (not shown) via an internal contact member 22.

Although the prior art push button assembly 10 of FIG. 1 is satisfactory from a performance standpoint, it is less than satisfactory in terms of construction and cost. From a construction perspective, the push button assembly of FIG. 1 is burdensome because there are required the steps of placing the spring 18 about the stem 12*a*, placing the seal 19 about the stem 12*a*, placing the push button member 12 into the bore 14 and placing the retainer clip 16 about the stem 12*a*. From a cost perspective, the push button assembly 10 of FIG. 1 is less than desirable because employing and assembling four separate components makes the push button assembly relatively high in cost.

An improved push button assembly is disclosed in U.S. Pat. No. 4,031,348 ('348) issued to Eberhardt on Jun. 21, 1977. As is the case for the push button assembly 10 of FIG. 1, the '348 push button assembly comprises a push button member and a retainer clip (in the form of a snap ring). However, unlike the push button assembly 10 of FIG. 1, the '348 push button assembly includes a resilient washer which dually functions as a spring and a seal. Since the '348 push button assembly employs one less component than the push button assembly 10 of FIG. 1, it offers both construction and cost advantages over the push button assembly 10 of FIG. 1.

Even though the '348 push button assembly offers advantages over the push button assembly 10 of FIG. 1, it would be desirable to provide a push button assembly which is a further improvement over the improved push button assembly of the '348 patent. Accordingly, it is the object of the present invention is to provide an improved push button assembly utilizing a minimum number of components and providing ease of assembly.

SUMMARY OF THE INVENTION

Briefly stated, this invention relates to a push button assembly for an electronic wrist instrument having a case, the case having a contact member and an integrated circuit disposed within, which comprises the case having a bore disposed therethrough, the bore including an outer portion, an inner portion having a tapered inner end, and a groove surrounding the inner portion; a push button member disposed and retained within the bore for slidingly urging contact with the contact member, the push button member comprising a head with an interior surface and a stem with a first end centrally disposed on the interior surface of the head, a tapered second end, and a circumferential groove disposed adjacent to the tapered second end to form an annular ledge at the interface thereof, the interior surface of the head having an annular groove encircling the first end of the stem, where the push button member is retained within the bore by the annular ledge providing a restraining means with respect to the tapered inner end of the bore; and a resilient, compressible gasket disposed about the stem, a first end of the gasket disposed in the annular groove on the interior surface of the push button member head and a second end of the gasket disposed in the groove surrounding the inner portion of the bore to provide sealing for the push button assembly, whereby when the head of the push button member is depressed, the tapered second end of the stem contacts the contact member to provide a means to operate the integrated circuit, and when the head of the push button member is released, the gasket acts as a spring means for returning the push button member from its depressed position to its undepressed position.

BRIEF DESCRIPTION OF THE DRAWINGS

The invention, both as to organization and to method of practice, together with further objects and advantages thereof, will best be understood by reference to the following specification, taken in connection with the accompanying drawings, in which.

DETAILED DESCRIPTION OF THE PREFERRED EMBODIMENT

Figure 1:
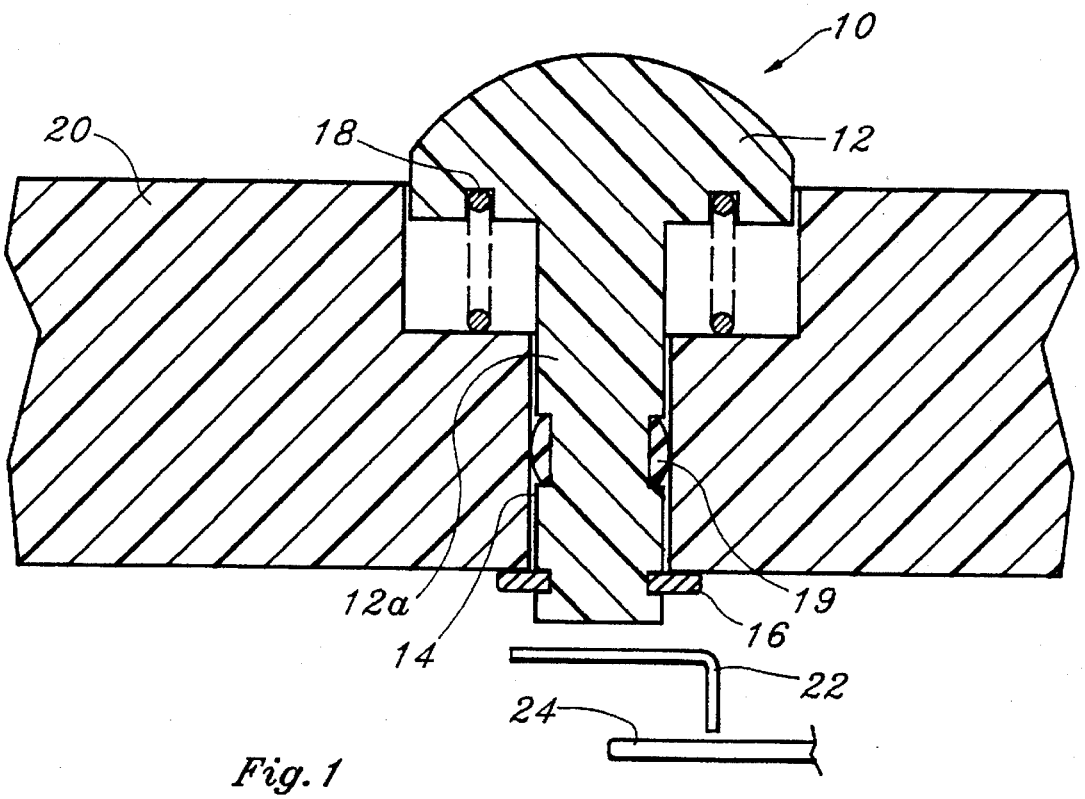
Fig. 1 (Prior Art)
FIG. 1 is an enlarged cross-sectional view of a prior art push button assembly disposed within a partially illustrated case of an electronic wrist instrument.
Figure 2:
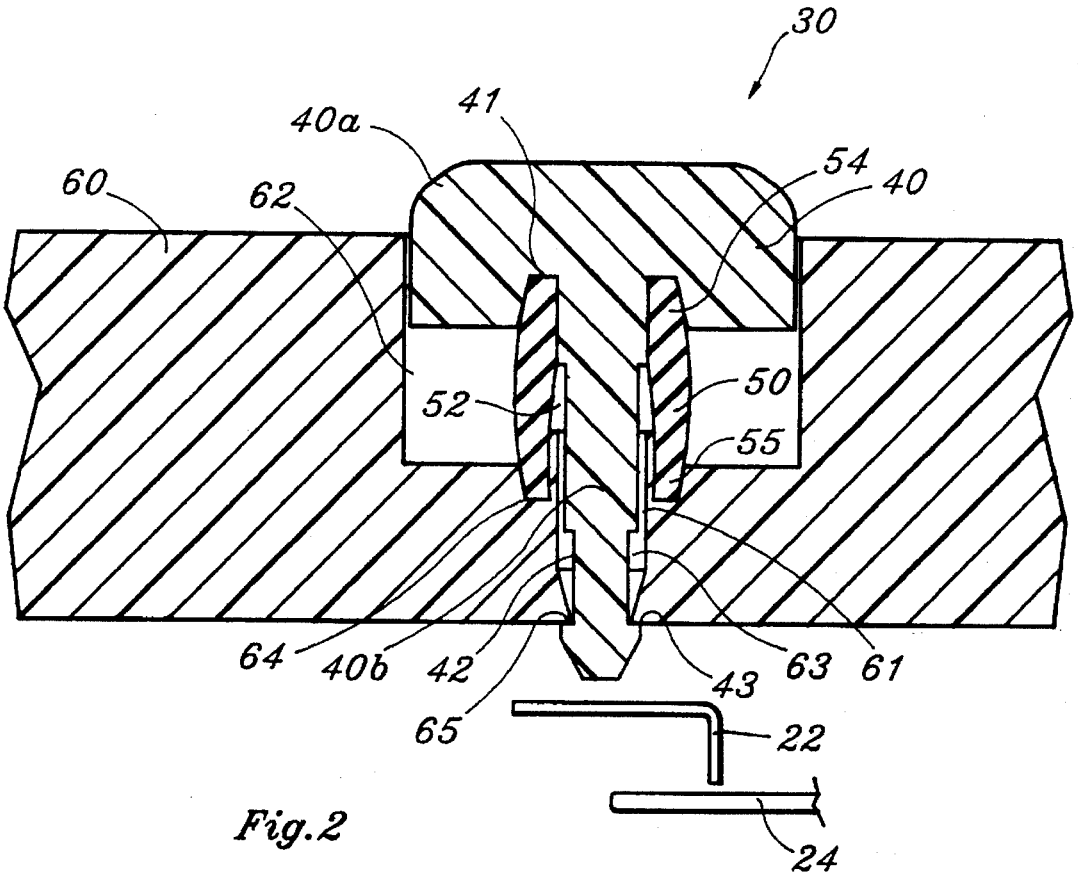
FIG. 2 is an enlarged cross-sectional view of the preferred embodiment of a push button assembly of the present invention shown in its undepressed or initial position.
Figure 3:
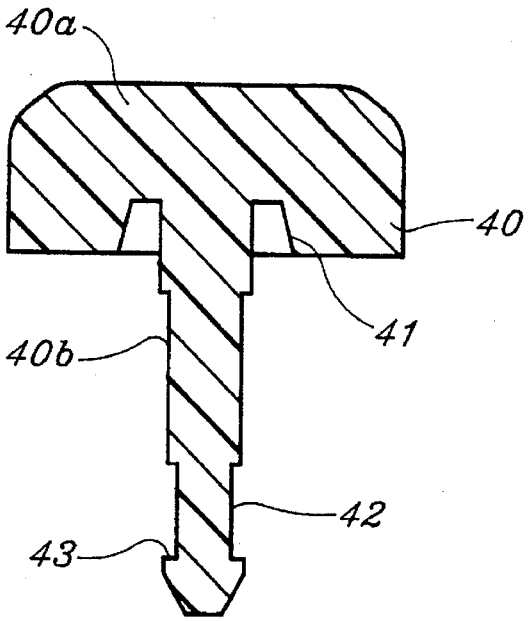
FIG. 3 is an elevation view of the push button member employed in the push button assembly of FIG. 2.

FIG. 2 is an enlarged cross-sectional illustration of an electronic wrist instrument's case 60 having a bore 61 for receiving an improved push button assembly 30 of the present invention, the improved push button assembly 30 comprising a push button member 40 and a gasket 50. In FIG. 2, the case 60 of the electronic wrist instrument is shown as being fabricated from plastic, although other materials, such as stainless steel, may also be used to fabricate the case 60. The push button member 40, which is shown more clearly in FIG. 3, has a head 40*a* and a generally cylindrical stem 40*b*, the stem 40*b* being centrally disposed on the interior surface of the head 40*a*. The interior surface of the head 40*a* has a tapered annular groove 41 encircling a first end of the stem 40*b* for receiving the gasket 50. The stem 40b includes a circumferential groove 42 disposed adjacent to a second end. Second, or terminating, end of the stem 40b is tapered, for example at a 30° angle from the axis of the stem 40b, to permit ease of insertion into the case 60 of the electronic wrist instrument, as will be described hereinbelow. The circumferential groove 42 adjacent to the second end results in the formation of an annular ledge 43. The push button member 40 may be fabricated from plastic, such as acrylonitrile-butadiene-styrene (ABS) plastics, as shown in FIG. 2, or from metal, such as stainless steel or brass.

The location of the bore 61 is typically on the side of the case 60, such as found on digital wristwatches. However, the improved push button assembly 30 of the present invention would perform equally as well if it was received by the bore 61 located on top of the case 60. The bore 61 includes an outer portion 62 for receiving the head 40a of the push button member 40. The outer portion 62 is shaped to conform to the shape of the head 40a; e.g., if the head 40a is circular, the outer portion 62 is circular in shape. The bore 61 further includes an inner portion 63 for receiving the stem 40b of the push button member 40. Although the inner portion 63 is generally shaped to conform to the shape of the stem 40b, the inner end 65 of the inner portion 63 is tapered to a diameter corresponding to the diameter of the stem 40b at the circumferential groove 42. Thus, the diameter of the inner end 65 of the inner portion 63 is less than the diameter of the second end of the stem 40b at the annular ledge 43. The tapered inner end 65 of the inner portion 63 permits the push button member 40 to be retained within the bore 61 without the need for a retainer clip, as will be described hereinbelow. Surrounding the inner portion 63 of the bore 61 is a tapered groove 64 for receiving the gasket 50.

The gasket 50 is a generally tubular structure fabricated from a resilient material, such as elastomer or rubber plastic. The gasket 50 has an interior bore 52 with a diameter sufficient to snugly receive the stem 40b of the push button member 40. The thickness of a first end 54 of the gasket 50 corresponds to the tapered annular groove 41 and the thickness of a second end 55 of the gasket 50 corresponds to the tapered surrounding groove 64. As is apparent from FIG. 2, the middle section of the gasket 50 is thicker than at the ends, the reason for which will be described hereinbelow.

In assembling the push button assembly 30 of the present invention for operation, the gasket is disposed about the stem 40b with the first end 54 of the gasket 50 entering the tapered annular groove 41 on the interior surface of the head 40a. The push button member 40 and the gasket 50 are then inserted into the bore 61, allowing the second end 55 of the gasket 50 to enter the tapered groove 64 surrounding the inner portion 63 of the bore 61. Note that in the insertion of the push button member 40, the second end of the stem 40b having the annular ledge 43 is urged past the tapered inner end 65 of the inner portion 63 so that the annular ledge 43 serves to retain the push button member 40 within the bore 61 of the electronic wrist instrument's case 60. The second end of the stem 40b can be urged past the tapered inner end 65 of the inner portion 63 of the bore 61 despite having the annular ledge 43 with a greater diameter than the tapered inner end 65 because the tapering of the second end of the stem 40b makes it significantly easier to slide the second end of the stem 40b through the tapered inner end 65 of the bore 61. Furthermore, given the typical size of the stem 40b (diameter less than 1 mm), the second end of the stem 40b is capable of being slightly deformed so as to be urged past the tapered inner end 65 of the inner portion 63. Once inserted, the head 40a of the push button member 40 fits snugly within the outer portion 62 of the bore 61 and the stem 40b of the push button member 40 fits snugly within the inner portion 63 of the bore 61 so as to virtually eliminate the side to side movement of the push button member 40 (see FIG. 2).

The operation of the improved push button assembly 30 of the present invention will be explained with reference to FIGS. 2 and 4. In FIG. 2, the push button assembly 30 is shown in an undepressed position. Although the push button assembly 30 is not depressed, the gasket 50 is in a slightly compressed state. This compression may be obtained by appropriate selection of the length of the stem 40b, the length of the gasket 50, the depth of the bore 61, or by other apparent adjustments. By applying sufficient pressure to the gasket 50 to cause slight compression, the push button assembly 30 of the present invention ensures that even when the head 40a of the push button member 40 is not depressed, the gasket 50 sealingly engages the tapered annular groove 41 and the tapered surrounding groove 64 to minimize or prevent moisture or other contaminants from entering the interior of the electronic wrist instrument's case 60.

Figure 4:
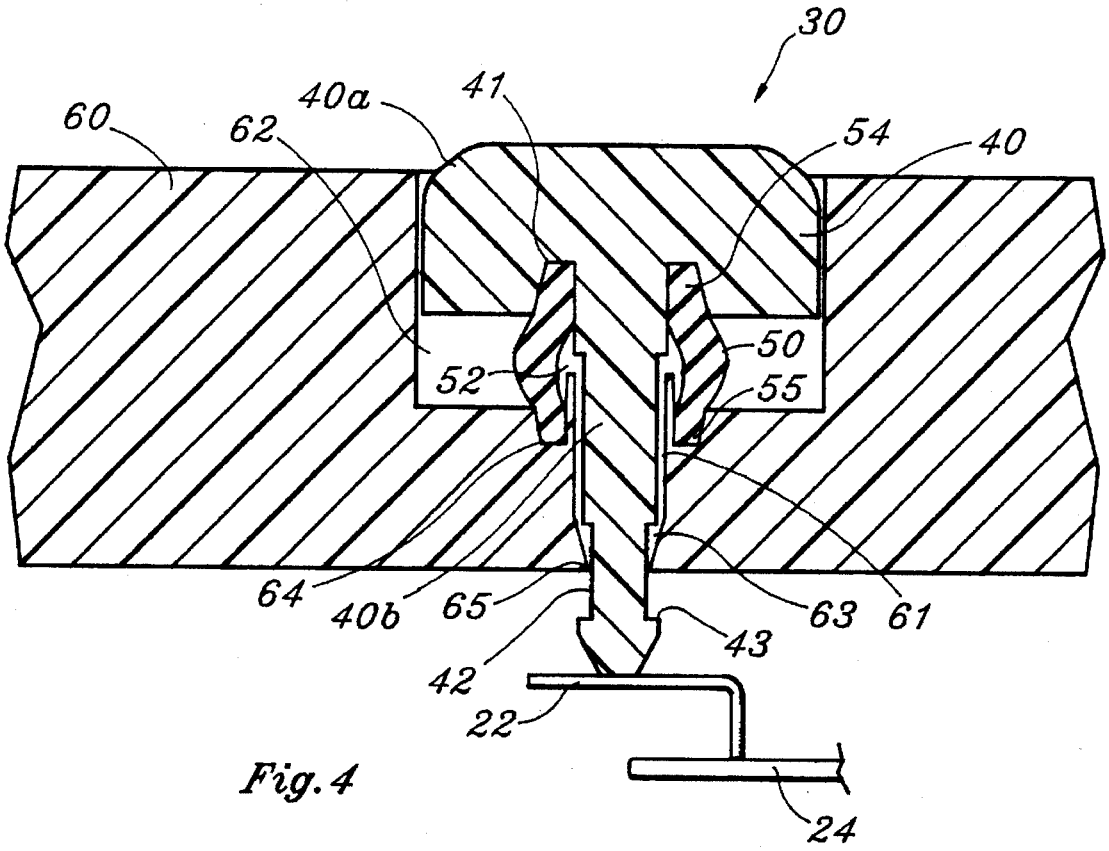
FIG. 4 illustrates the push button assembly of FIG. 2 in its depressed position.

FIG. 4 illustrates the push button assembly 30 in a depressed position. Note that when the head 40a of the push button member 40 is manually depressed, the gasket 50 is compressed and the second end of the stem 40b is slidingly urged against the internal contact member 22. The internal contact member 22 in turn operates a switch 24 connected to the integrated circuit (not shown), thereby enabling a user to select a desired function of the wrist instrument in a manner well-known in the art. The depression of the push button member 40 does not alter the sealing engagement of the gasket 50 with respect to the tapered annular groove 41 and the tapered surrounding groove 64. Therefore, when the head 40a of the push button member 40 is manually depressed, the gasket 50 continues to minimize or prevent moisture or other contaminants from entering the interior of the electronic wrist instrument's case 60.

In addition to providing a dynamic seal, the gasket 50 also acts as a spring means for returning the push button member 40 from its depressed position (FIG. 4) to its undepressed position (FIG. 2). The thicker middle section of the gasket 50 relative to the ends 54 and 55 adds resiliency to the gasket 50. Furthermore, the thicker middle section of the gasket 50 adds strength to the generally tubular structure of the gasket 50 so that the useful life span of the gasket 50 prolonged.

While there has been described what is considered the preferred embodiment of the invention, modifications of the present invention will occur to those skilled in the art, and it is desired to secure in the appended claims all such modifications as fall within the true spirit and scope of the invention.

We claim:

1. A push button assembly for an electronic wrist instrument having a case, the case having a contact member and an integrated circuit disposed within, which comprises:

the case having a bore disposed therethrough, the bore including an outer portion, an inner portion having a tapered inner end, and a groove surrounding the inner portion;

a push button member disposed and retained within the bore for slidingly urging contact with the contact member, the push button member comprising a head with an interior surface and a stem with a first end centrally disposed on the interior surface of the head, a tapered second end, and a circumferential groove disposed adjacent to the tapered second end to form an annular ledge at the interface thereof, the interior surface of the head having an annular groove encircling the first end of the stem, where the push button member is retained within the bore by the annular ledge providing a restraining means with respect to the tapered inner end of the bore; and a resilient, compressible gasket disposed about the stem, a first end of the gasket disposed in the annular groove on the interior surface of the push button member head and a second end of the gasket disposed in the groove surrounding the inner portion of the bore to provide sealing for the push button assembly, whereby when the head of the push button member is depressed, the tapered second end of the stem contacts the contact member to provide a means to operate the integrated circuit, and when the head of the push button member is released, the gasket acts as a spring means for returning the push button member from its depressed position to its undepressed position.

2. The push button assembly according to claim 1, wherein the diameter of the stem is less than 1 mm.

3. The push button assembly according to claim 1, wherein the gasket is fabricated from elastomer.

4. The push button assembly according to claim 1, wherein the gasket is fabricated from rubber plastic.

5. The push button assembly according to claim 1, wherein the gasket is substantially tubular in shape.

6. The push button assembly according to claim 5, wherein the gasket is thicker in the middle than at the ends.

7. The push button assembly according to claim 1, wherein the groove surrounding the inner portion of the bore and the annular groove on the interior surface of the push button member head are tapered.

8. The push button assembly according to claim 1, wherein the electronic wrist instrument is a digital watch.

9. A push button assembly for an electronic wrist instrument having a case, the case having a contact member and an integrated circuit disposed within, which comprises:

the case having a bore disposed therethrough, the bore including an outer portion, an inner portion having a tapered inner end, and a tapered groove surrounding the inner portion;

a push button member disposed and retained within the bore for slidingly urging contact with the contact member, the push button member comprising a head with an interior surface disposed within the outer portion of the bore and a stem with a first end centrally disposed on the interior surface of the head, a tapered second end, and a circumferential groove disposed adjacent to the tapered second end to form an annular ledge at the interface thereof, the stem other than the tapered second end being disposed within the inner portion of the bore, the interior surface of the head having a tapered annular groove encircling the first end, where the push button member is retained within the bore by the annular ledge providing a restraining means with respect to the tapered inner end of the bore; and a resilient, compressible, substantially tubular gasket disposed about the stem, a first end of the gasket disposed in the tapered annular groove on the interior surface of the push button member head and a second end of the gasket disposed in the tapered groove surrounding the inner portion of the bore to provide sealing for the push button assembly, whereby when the head of the push button member is depressed, the tapered second end of the stem contacts the contact member to provide a means to operate the integrated circuit, and when the head of the push button member is released, the gasket acts as a spring means for returning the push button member from its depressed position to its undepressed position.

10. The push button assembly according to claim 9, wherein the gasket is fabricated from elastomer.

11. The push button assembly according to claim 9, wherein the gasket is fabricated from rubber plastic.

12. The push button assembly according to claim 9, wherein the gasket is thicker in the middle than at the ends.

13. The push button assembly according to claim 9, wherein the electronic wrist instrument is a digital watch.

* * * * *